US007351289B2

(12) United States Patent
Grabscheid et al.

(10) Patent No.: US 7,351,289 B2
(45) Date of Patent: Apr. 1, 2008

(54) APPLICATION DEVICE

(75) Inventors: Joachim Grabscheid, Gerstetten (DE); Martin Kustermann, Heidenheim (DE); Stefan Reich, Heidenheim (DE); Eckard Wozny, Heidenheim (DE); Manfred Ueberschaer, Gerstetten (DE)

(73) Assignee: Voith Paper Patent GmbH, Heidenheim (DE)

( * ) Notice: Subject to any disclaimer, the term of this patent is extended or adjusted under 35 U.S.C. 154(b) by 239 days.

(21) Appl. No.: 11/150,390

(22) Filed: Jun. 9, 2005

(65) Prior Publication Data

US 2005/0284365 A1 Dec. 29, 2005

(30) Foreign Application Priority Data

Jun. 17, 2004 (DE) ..... 10 2004 029 291

(51) Int. Cl.
*B05C 11/04* (2006.01)

(52) U.S. Cl. ..... 118/413; 118/501; 118/118; 118/119; 118/126

(58) Field of Classification Search ..... 118/413, 118/501, 118, 119, 126, 249, 256; 427/356; 162/281

See application file for complete search history.

(56) References Cited

U.S. PATENT DOCUMENTS 4,712,506 A 12/1987 Rantanen et al. ..... 118/103
5,417,762 A * 5/1995 Sieberth ..... 118/126
5,454,870 A * 10/1995 Sieberth ..... 118/258
5,660,631 A 8/1997 Eriksson ..... 118/106
5,868,073 A * 2/1999 Ebina ..... 101/425
6,342,126 B1 * 1/2002 Grabscheid et al. ..... 162/203

FOREIGN PATENT DOCUMENTS

DE 3735889 5/1988
EP 0687770 12/1995

* cited by examiner

*Primary Examiner*—Laura Edwards
(74) *Attorney, Agent, or Firm*—Taylor & Aust, P.C.

(57) ABSTRACT

A device for applying a liquid to pasty medium to a moving surface, the moving surface in the case of direct application being the surface of a paper, board or other fibrous web. In the case of indirect application the moving surface being the surface of a transfer element which transfers the application medium to the surface of the fibrous web. The device includes an applicator for applying the medium and a doctor device arranged downstream in the running direction of the moving surface for doctoring off and/or equalizing the medium applied to the moving surface. In order to collect excess medium that has not remained on the moving surface and/or has not reached the latter, a flexible collecting part covering the interspace between applicator and doctor device is provided, which extends transversely with respect to the running direction of the moving surface and parallel to the applicator and the doctor device.

11 Claims, 2 Drawing Sheets

APPLICATION DEVICE

BACKGROUND OF THE INVENTION

1. Field of the Invention

The present invention relates to a device for applying a liquid to pasty medium to a moving surface, the moving surface in the case of direct application being the surface of a paper, board or other fibrous web. In the case of indirect application the moving surface being the surface of a transfer element, for example an applicator roll, which transfers the application medium to the surface of the fibrous web, an applicator for applying the medium and a doctor device arranged downstream in the running direction of the moving surface for doctoring off and/or equalizing the medium applied to the moving surface.

2. Description of the Related Art

Application devices are known, where during application of the medium with the applicator, for example in the case of a nozzle applicator, where the liquid to pasty medium is applied under pressure to the surface to be coated, not all parts of the medium reach the moving surface and therefore spray into the surroundings. The collection of the spray is carried out with what is known as a discharge tray, which is normally fixed directly to the applicator and ends underneath a discharge plate belonging to the doctor device and overlapping the latter slightly. However, this construction has various disadvantages.

Firstly, the medium running off the discharge plate of the doctor device or wiped off by a doctor element, such as a blade, doctor bar, or a rotating metering rod, such as coating, size, starch, impregnant, splashes forcibly in free fall onto the discharge tray located underneath, which also collects the medium originating from the application device. As a result, high spraying movements are produced of a type which both reach machine parts and, as a result, ensure defects, and reach the freshly coated surface again and there have a negative influence on the application result.

In addition, on account of the rigid design of the discharge plate and the discharge tray which, in the operating state, are located with their free ends close to each other, limits are placed on the freedom of movement during pivoting-away movements of the applicator and the doctor device.

What is needed in the art is a device for collecting the excess medium which minimizes or eliminates splashing of the medium, and which is not rigid.

SUMMARY OF THE INVENTION

The present invention provides, in order to collect excess medium that has not remained on the moving surface and has not reached the latter, a flexible collecting part covering the interspace between applicator and doctor device which extends transversely with respect to the running direction of the moving surface and parallel to the applicator and the doctor device.

The invention comprises, in one form thereof, a device for applying a liquid to pasty medium to a moving surface, the moving surface in the case of direct application being the surface of a paper, board or other fibrous web and in the case of indirect application being the surface of a transfer element which transfers the application medium to the surface of the fibrous web. The device includes an applicator for applying the medium and a doctor device arranged downstream in the running direction of the moving surface for doctoring off and/or equalizing the medium applied to the moving surface. In order to collect excess medium that has not remained on the moving surface and/or has not reached the latter, a flexible collecting part covering the interspace between the applicator and doctor device is provided, which extends transversely with respect to the running direction of the moving surface and parallel to the applicator and the doctor device.

As a result, the action of keeping clean the entire application device and the other components of a coating machine is improved. In particular, defects in the application quality are dispensed with by avoiding the spraying of medium. In addition, the effort on cleaning, primarily of machine parts that are difficult to access, is reduced.

The collecting part can be configured very expediently if it is formed as a cloth and including materials such as rubber, polymer-coated woven fabric, plastic and the like.

As a result, it is particularly flexible and can follow any movement of the applicator and of the doctor device without difficulty. The material chosen can itself be cleaned easily and, above all, is rugged.

The cleaning of the collecting part, that is to say of the flexible cloth, can be made considerably easier or delayed if it is coated with a contamination-repellant material, such as Teflon. This can be carried out in a partial coating or else in a complete coating.

An advantageous refinement of the present invention can include the flexible collecting part being fixed in each case to an outer, mutually facing longitudinal wall of the applicator and the doctor device. This fixing can be provided by hooking in, clamping in and the like. As a result, the collecting part can be replaced easily and substituted quickly in the event of damage. The fitting can be carried out in such a way that it is pre-draped outside the coating machine and then drawn into the application device in a simple way in a manner similar to a drape.

In this connection, other suspension possibilities are also conceivable, such as hooks or snap fasteners fitted to the applicator and the doctor device, into which, as a mating piece, the flexible collecting part engages with eyes and similar mating pieces. The arrangement of an inflatable hose is also conceivable, with which the collecting part can be fixed or pressed on in a guide.

In order to be able to collect the application medium as completely as possible, provision is made to form the collecting part so as to sag, so that it forms a type of pocket. At least one drain for the collected medium is provided on its lower, sagging section. The one drain that is present or the plurality of drains arranged distributed uniformly over the entire length of the flexible discharge part can then be connected to extraction devices. The application medium can then be cleaned, deaerated and made available to the applicator again for the application process. The drain or drains can be stuck, welded or else clamped into the collecting part, depending on the material used for the latter.

The collecting part according to the present invention is distinguished by the fact that it is self-cleaning. The collecting part or collecting cloth can best be moved, on account of its structure. For example, the collecting part can be drawn up or rolled up or else moved in another suitable way laterally beside the applicator and/or the doctor device. The aforesaid movement causes a flexing or shaking movement, as a result of which the parts of the medium that have been collected and partly dried on crumble off or flake off. These particles can be carried away with the rest of the medium. Additional cleaning devices are therefore not absolutely necessary.

An advantage of the device according to the present invention resides above all in lower effort on production and maintenance and in possible simpler cleaning, if the latter is at all necessary. Because of the step-free possibility of discharging the application medium, an improved application quality is achieved, since far less spraying of application medium is to be noted. In addition, the present invention offers a better possible way of discharging what is known as color mist, which forms in the space between applicator and doctor device and can likewise have a negative effect on the application result.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
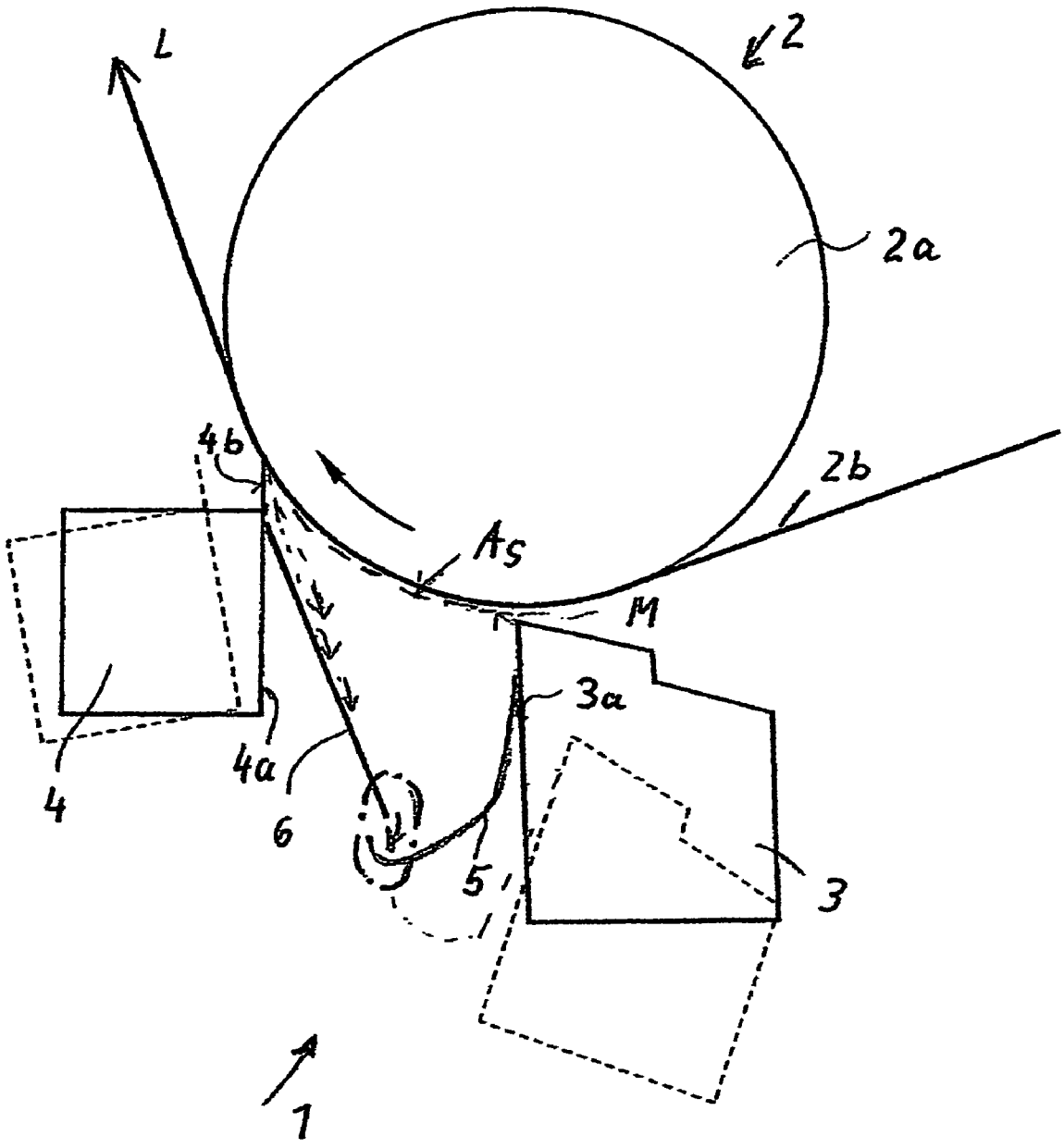
FIG. 1 is a schematic side view of an application device according to the prior art.

FIG. 1 shows an application device 1 in a roughly schematic illustration. A surface 2 moving in the running direction L, which here is a fibrous web 2*b* of paper or board running around a supporting roll 2*a*, is to be coated directly by an applicator 3. In this example a nozzle applicator is provided for this purpose, which discharges an application medium M onto a web 2*b* in the form of a free jet under pressure.

In the event of indirect application, not illustrated, there is what is known as an applicator roll which transfers medium M to the fibrous web on a section of a roll, not shown.

Supporting roll 2*a* is likewise assigned a doctor device 4. The latter is spaced apart from applicator 3 to a specific extent in the running direction L of fibrous web 2*b*, corresponding to the desired time of action of the application medium (coating color, size, starch and the like). After this desired time of action by way of an adjustable spacing, an appropriate doctor element, for example a doctor blade 4*b*, wipes off the medium previously applied in excess by the applicator or application nozzle 3, brings it to the desired coat weight in g/m$^2$ and, in the process, evens out the application layer $A_S$. By contrast, if the medium M is applied without excess (what is known as 1:1 application, that is to say that which is applied also remains on web 2), the doctor element or doctor blade 4*b* shown performs only distribution of the medium M and evening out of the application layer $A_S$.

Fixed to an outer wall 3*a* of applicator 3 is a collecting tray or collecting trough 5. Tray 5 collects those particles of medium which, for example as a result of spraying off, do not reach web 2*b* at all or remain adhering thereto.

A collecting device is likewise fitted to doctor device 4 or its outer wall 4*a*, applicator outer wall 3*a* facing the doctor device outer wall 4*a*. The collecting device is constructed in the form of a discharge plate 6 for the excess medium wiped off, extending obliquely downward from outer wall 4*a*. It is arranged with its free lower end above the collecting tray 5 and overlaps this tray 5 slightly.

A critical point of the device is shown in a dash-dotted oval. The medium doctored off and running down flows and splashes off the discharge plate 6 in free fall onto the tray 5 located underneath and, as a result, causes considerable splashes, which strike machine parts and fibrous web 2*b* and there give rise to defects and losses of quality in the application layer $A_S$.

The positions of applicator 3 and doctor device 4 which they assume when pivoted down, for example in the service state, are shown in dashed lines. It is possible to conceive that the rigid and bulky discharge plate 6 and discharge tray 5, which consist of metallic material, can be in each other's way and hinder each other under certain circumstances.

Figure 2:
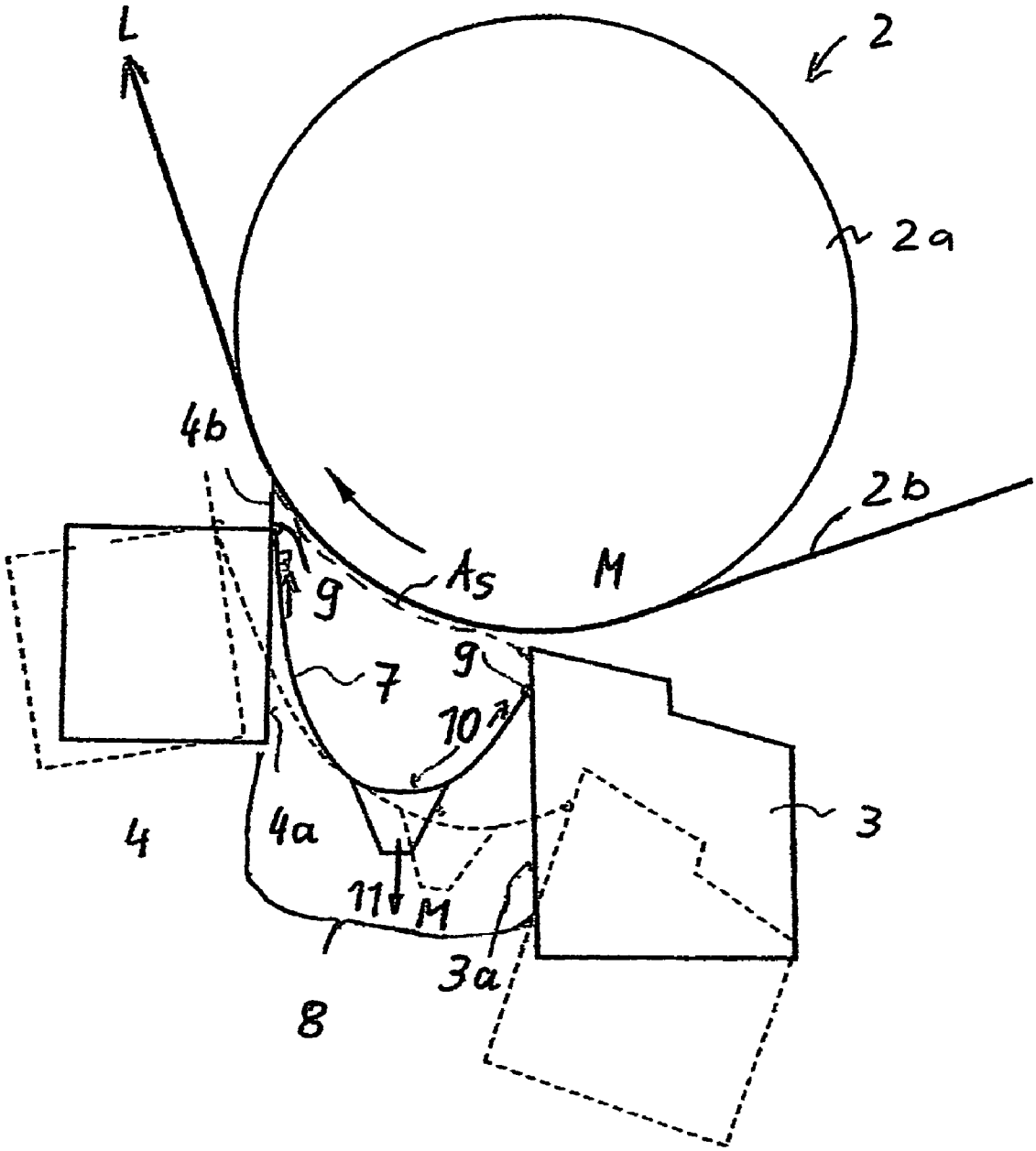
FIG. 2 is a schematic side view of an embodiment of an application device according to the present invention.

By contrast, the device according to the present invention is illustrated schematically in FIG. 2. Its components include some of those of the prior art illustrated in FIG. 1. Instead of the rigid metallic discharge surfaces 5 and 6 present in the embodiment of FIG. 1 however, a flexible discharge part 7 is provided in the present invention according to FIG. 2.

This is used for the joint collection of:

1. Excess medium which has not remained on moving surface 2, that is to say fibrous web 2*b* (i.e. medium doctored off); and
2. Medium which has not reached surface 2 during application. Flexible collecting part 7 covers interspace 8 between applicator 3 and doctor device 4. Collecting part 7 extends transversely with respect to the running direction (L) of the moving surface and parallel to applicator 3 and doctor device 4, however, in a similar way as the previous discharge plates or trays.

Collecting part 7 is formed in the manner of a cloth and is therefore particularly flexible and, when removed, can simply be folded together and stored. It can be fabricated from the materials rubber or polymer-coated woven fabric (similar to a truck tarpaulin), or a plastic or the like.

Collecting part 7 is at least partly coated with a contamination-retardant material, such as PTFE, and therefore the particles of medium that are collected easily run off.

Collecting part 7 is fixed at its two ends to in each case an outer, mutually facing longitudinal wall 3*a* of applicator 3 and longitudinal wall 4*a* of doctor device 4. Fixing in special devices 9 can be carried out by way of hooking in, clamping in and the like, similar to hanging a drape, which denotes that collecting part 7 can easily be fitted, removed and replaced, even washed or shaken out.

FIG. 2 reveals that collecting part 7 is designed so as to sag and, in its lower, sagging section 10, has at least one drain 11 for medium M collected.

The at least one drain 11 can be stuck, welded or clamped into the collecting part 7.

Collecting part 7 is, so to speak, self-cleaning. It can be drawn up or wound up laterally, as indicated by arrows in the example, in the installed state or can be moved in another way, for example can be flexed or shaken. In any case, the effect of the movement is that the parts of the medium that have dried on in the intervening time flake off the surface of the collecting part, fall downward and can then be carried away via drain 11 described above together with the rest of the medium collected.

The thrown-on positions of applicator 3 and doctor device 4, indicated by dashed lines in this FIG. 2, with respect to moving surface 2 show the particular flexibility of collecting part 7. The latter covers interspace 8 completely in a line and without forming any steps, even if the thrown-on positions of 3 and 4 have been changed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for applying a liquid to pasty application medium to a moving surface having a running direction, the moving surface in a case of direct application being a surface of a fibrous web, the moving surface in a case of indirect application being a surface of a transfer element which transfers the application medium to a surface of the fibrous web, said device comprising:

an applicator for applying the application medium, said applicator including an outer longitudinal wall;

a doctor device arranged downstream of said applicator in the running direction of the moving surface, said doctor device for at least one of doctoring off the application medium applied to the moving surface and equalizing the application medium applied to the moving surface, said doctor device and said applicator defining an interspace therebetween; and a substantially flexible collecting part covering said interspace between said applicator and said doctor device, said flexible collecting part extending transversely with respect to the running direction of the moving surface and parallel to said applicator and said doctor device, said substantially flexible collecting part collecting an excess said application medium that at least one of has not remained on the moving surface and has not reached the moving surface, said substantially flexible collecting part being fixed to said outer longitudinal wall and to said doctor device by at least one of hooking in and clamping in, said outer longitudinal wall facing said doctor device, said substantially flexible collecting part being replaceable.

2. The device of claim 1, wherein the fibrous web is one of a paper web and a board web.

3. The device of claim 1, wherein said collecting part is formed as a cloth which includes at least one of rubber, polymer-coated woven fabric, plastic and composites thereof.

4. The device of claim 1, wherein said collecting part is at least partly coated with a contamination-repellant material.

5. The device of claim 4, wherein said contamination-repellant material is polytetrafluoroethylene.

6. The device of claim 1, wherein said collecting part is formed so as to sag, said collecting part including a lower sagging section and at least one drain on said lower sagging section for a collected said excess application medium.

7. The device of claim 6, wherein said at least one drain is one of stuck into said collecting part, welded into said collecting part and clamped into said collecting part.

8. The device of claim 6, wherein said collecting part is self cleaning in that said collecting part can be moved, wherein a moving of said collecting part results in a plurality of parts of a dried said excess application medium which flake off and are carried away via said at least one drain with a remainder of said excess application medium.

9. The device of claim 8, wherein said moving of said collecting part results in one of a drawn up said collecting part and a rolled up laterally said collecting part.

10. The device of claim 1, wherein said collecting part includes a flexible member which collects said excess application medium.

11. The device of claim 1, wherein the application medium is a coating medium, said applicator being configured for applying said coating medium one of directly and indirectly to the surface of the fibrous web.

* * * * *